United States Patent [19]

Coffey

[11] 4,303,010

[45] Dec. 1, 1981

[54] REFUSE DISPOSAL SYSTEM

[75] Inventor: Manus Coffey, Newtownmountkennedy, Ireland

[73] Assignee: Murco Environmental Limited, Dublin, Ireland

[21] Appl. No.: 149,409

[22] Filed: May 13, 1980

[30] Foreign Application Priority Data

May 14, 1979 [IE] Ireland ..... 408/79

[51] Int. Cl.[3] ..... B30B 15/00

[52] U.S. Cl. ..... 100/100; 100/145; 100/215; 100/229 A

[58] Field of Search ..... 100/100, 229 A, 145, 100/146, 147, 148, 149, 150; 52/204; 49/370

[56] References Cited

U.S. PATENT DOCUMENTS

| | | | |
|---|---|---|---|
| 3,575,103 | 4/1971 | Charles | 100/229 A |
| 3,604,345 | 9/1971 | Boje | 100/229 A |
| 3,704,549 | 12/1972 | McGhee | 49/370 |
| 4,071,991 | 2/1978 | Hulligan | 100/229 A |

FOREIGN PATENT DOCUMENTS

| | | | |
|---|---|---|---|
| 488605 | 5/1970 | Switzerland . | |
| 491340 | 8/1938 | United Kingdom . | |
| 1324992 | 7/1973 | United Kingdom | 100/145 |

*Primary Examiner*—Peter Feldman

*Attorney, Agent, or Firm*—Sughrue, Mion, Zinn, Macpeak and Seas

[57] ABSTRACT

The Specification concerns a refuse disposal system in which a refuse compacting unit located adjacent a wall of a building has a refuse input accessible from inside the building and a refuse output accessible from outside the building for discharging compacted refuse into a removable container.

In order to permit a high degree of freedom in the placement of the container the unit is mounted on wheels for mobility and is located in an aperture in the wall, the aperture being substantially wider than the unit. The unit is disposed between a pair of sliding doors mounted for movement parallel to the wall, the doors being coupled to opposite sides of the unit by upwarding directed rollers on the doors engaging inverted channels along opposite sides of the unit. This arrangement permits free movement of the unit in a horizontal plane within the dimensional limitations of the arrangement, while ensuring that substantially the full width of the aperture in the wall is occupied by the combination of the unit and doors.

13 Claims, 8 Drawing Figures

REFUSE DISPOSAL SYSTEM

Figure 1:
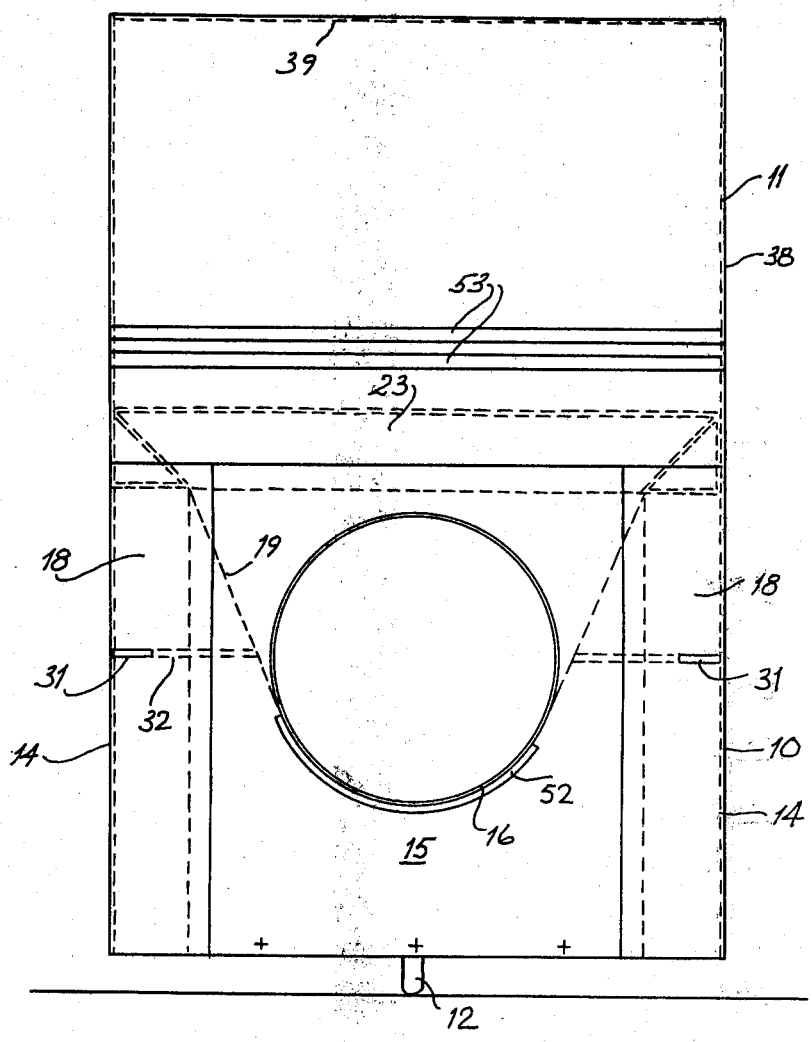

This invention relates to a refuse disposal system.

There are many different makes of refuse compactor units which use hydraulically powered cylinders to push a compacting ram backwards and forwards in a compacting chamber. The object of these machines is to reduce the volume of refuse and compact it into a container. These containers may either be detached from the compacting unit for removal and emptying or may be an integral part of the compacting unit in which case the complete machine is removed to the dumping area for emptying.

Existing systems are designed so that the compacting unit and the container are in a straight line, and a typical installation may be as long as 10 meters or more. In addition the truck which must pick up the container may require a further 15 meters to enable it to align itself with the container for pick up. Thus a typical installation will require around 25 meters in a straight line. Where integral compactor units and containers are used the space requirements may be somewhat less but a further problem arises as the discharging door of the container must be at the opposite end to the compacting unit. Therefore when the complete machine is picked up by the truck the compacting unit must be at the forward end of the truck to enable it to discharge and if, as is common, the machine when in its compacting position is arranged at 90° to the wall of the building where it is used, the compacting unit will be furthest away from the building, requiring a long walk for the operatives when loading it with refuse.

It is common practice for a compactor unit to be installed inside a building, pushing the refuse through a hole in the wall of the building into a container outside the building. Typically the compacting unit will require a space of about 5 meters long and 2½ meters wide inside the building thus utilising valuable floor space. Where the compactor unit is located inside the building this has the advantages that the operators are protected from the weather and do not have to transport refuse by hand for long distances; and that pilferage (which can be a serious problem where the operatives are going in and out of the building with containers of refuse) is reduced. In such cases the compactor unit is rigidly attached to the floor of the building, and when the container is dropped off by the truck driver it must be very accurately lined up with the compactor unit and then pulled into its final position by large screw jacks and clamps requiring very considerable effort on the part of the truck driver.

If we analyse the requirements of, for example, a typical supermarket we find that the ideal system will have the compacting unit inside the building and the container outside the building. The compactor unit should require little floor space and it should be possible to locate the container at various angles relative to the building so as to give the optimum access for the collecting trucks, without taking up valuable car parking or other space. Most usually it will be found that the best position for the container will be alongside the wall of the building. The container should be detachable from the compactor unit by the truck driver without his having access to the inside of the building; and the operators of the compactor unit should not have access to the outside of the building. The truck driver should be able to attach the container to the compactor unit with only a small amount of effort.

It is an object of the present invention to provide a refuse disposal system which may be designed to achieve these desirable requirements.

Accordingly, the present invention provides a refuse disposal system comprising a mobile refuse compacting unit located in an aperture in a wall of a building between a pair of sliding doors mounted for movement parallel to the wall, the aperture being wider than the unit and the doors being coupled to opposite sides of the unit respectively so as to permit a degree of horizontal movement of the unit in directions both parallel and perpendicular to the wall respectively and also a degree of rotational movement about a vertical axis, the doors and the unit in any position of the latter occupying substantially the full width of the aperture, and the unit having a refuse input accessible from inside the building and a refuse output accessible from outside the building.

Figure 2:
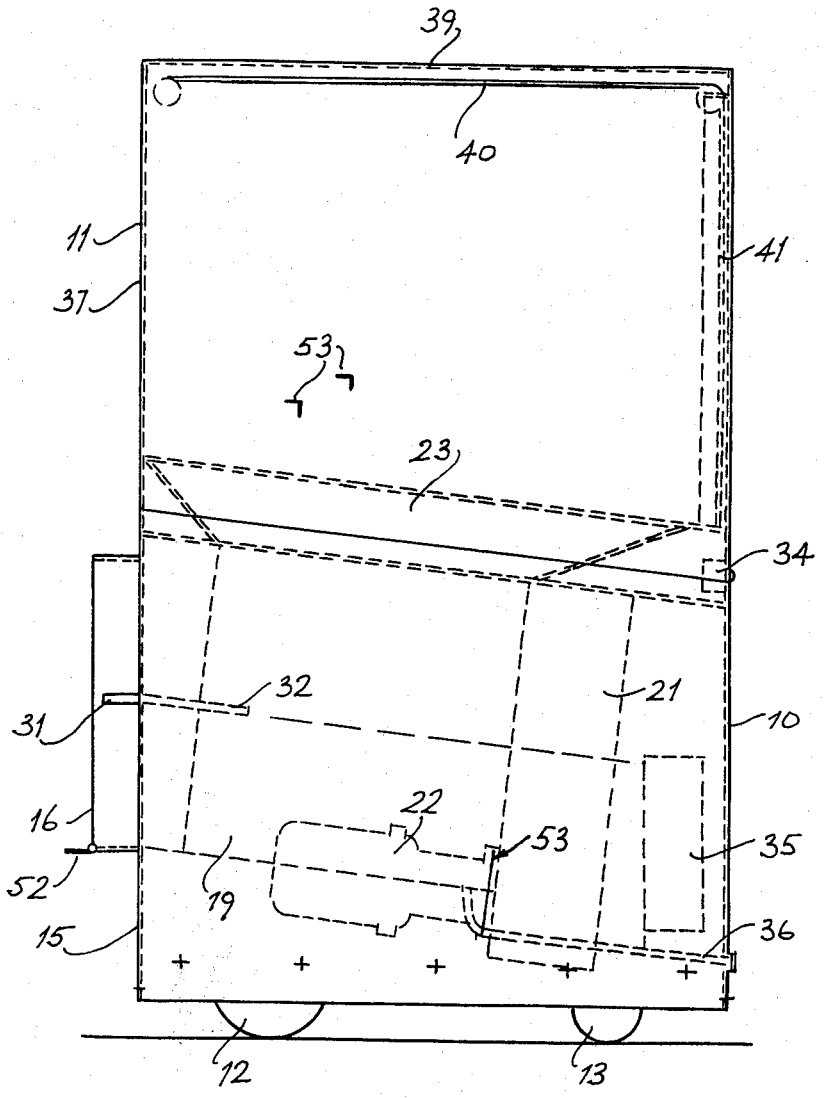
Figure 3:
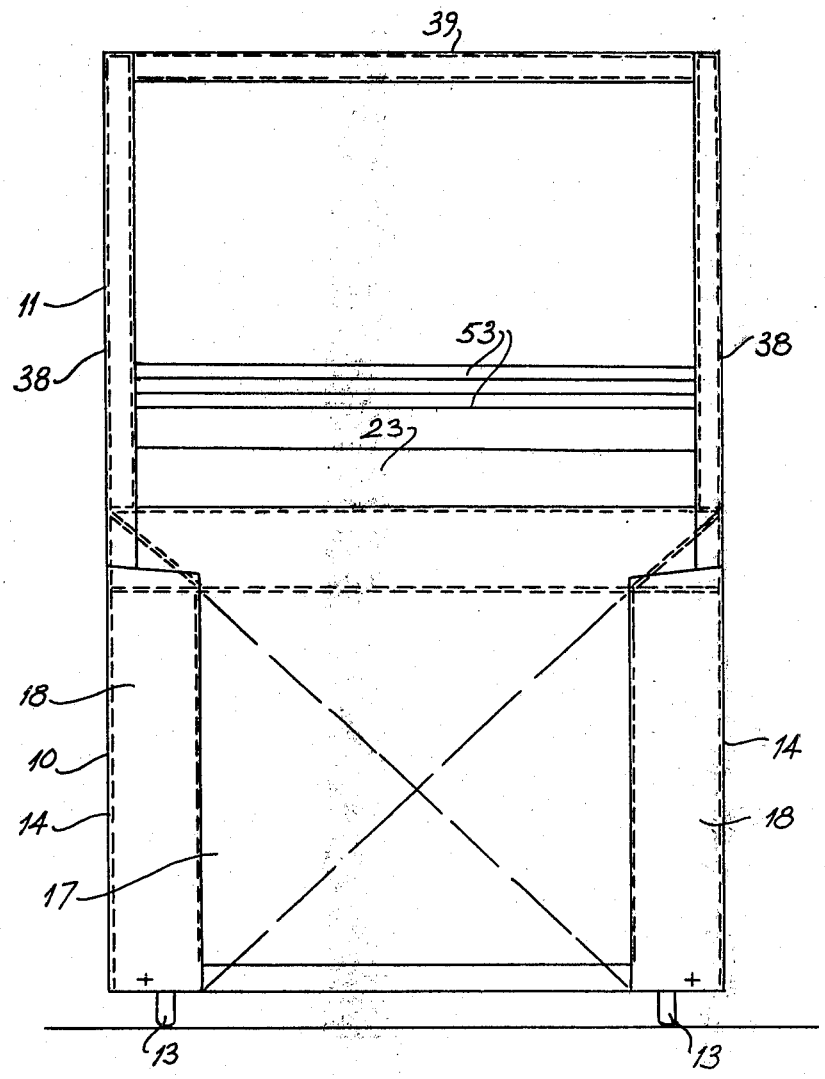
Figure 4:
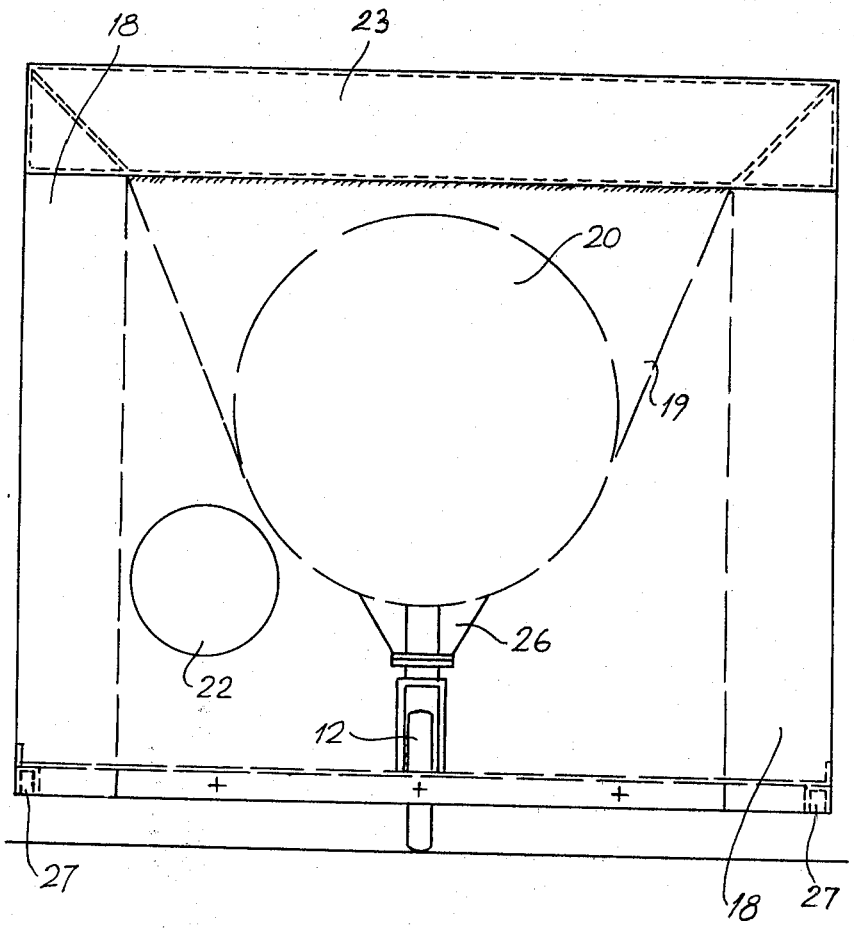
Figure 5:
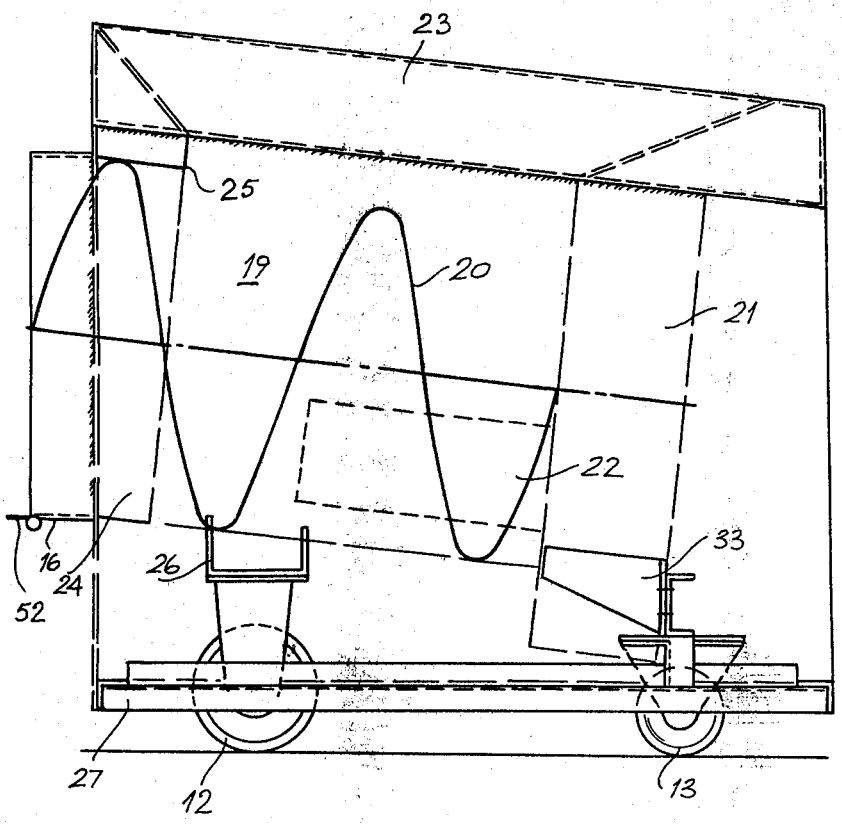
Figure 6:
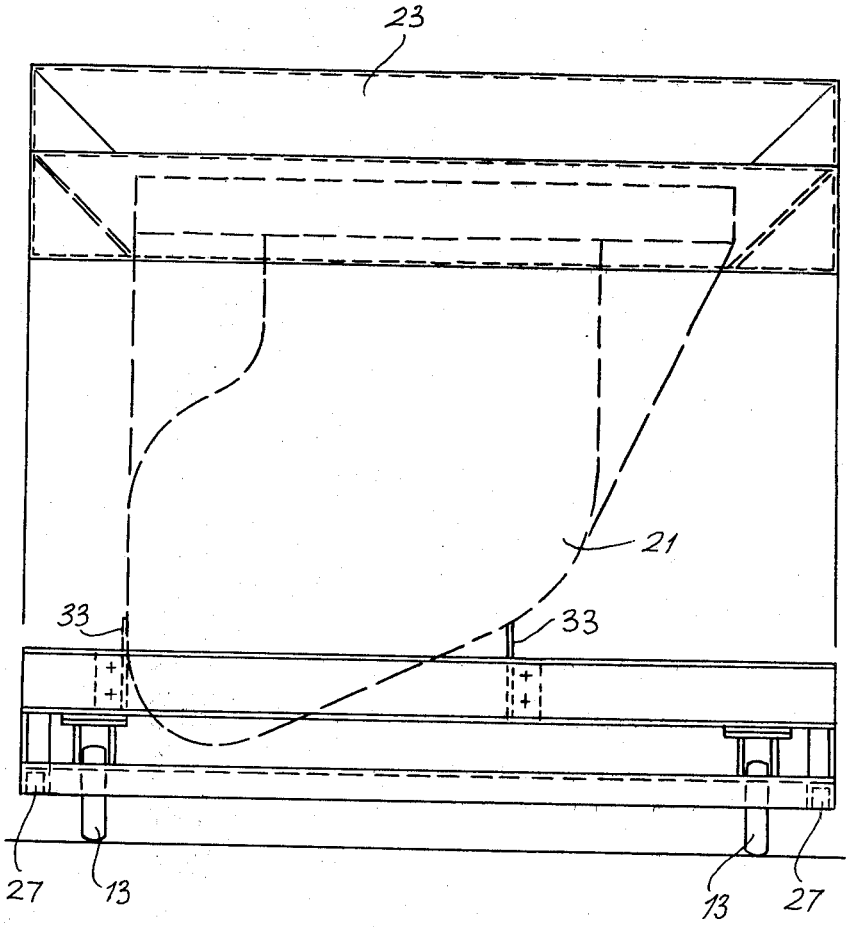
Figure 7:
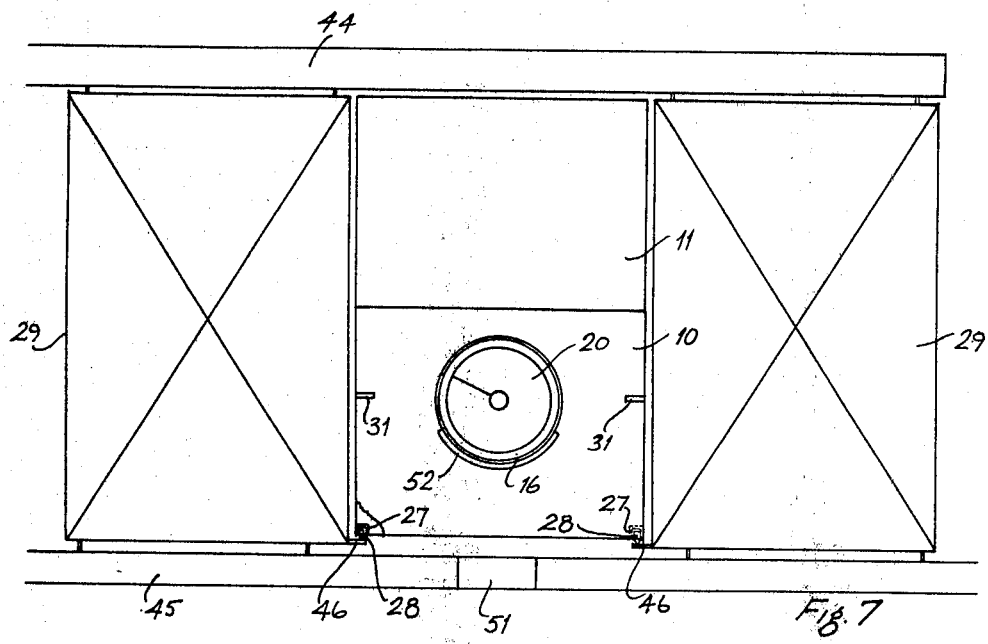

An embodiment of the invention will now be described, by way of example, with reference to the accompanying drawings, in which:

FIGS. 1 to 3 are schematic front, side and rear views respectively of a refuse compactor unit used in an embodiment of a system according to the invention, FIGS. 4 to 6 are schematic front, side and rear views respectively of the compactor unit subassembly, i.e. without the housing, FIG. 7 is a front view of a refuse disposal system incorporating the unit of FIGS. 1 to 6, and FIG. 8 is a schematic plan view of the refuse disposal system of FIG. 7.

Referring first to FIGS. 1 to 6 of the drawings, the refuse compacting unit of the system comprises a generally box-shaped housing comprising a main body portion 10 and a detachable hood 11, and is mounted on three wheels consisting of a single front wheel 12 and two rear wheels 13. The wheels 12 and 13 are each rotatable about a vertical axis so as to permit the unit to be moved, by pushing, in any desired direction. The unit is typically about 1.4 meters square in horizontal cross-section.

The main body 10 of the housing comprises opposite side panels 14, a front panel 15 having an extension piece 16 welded thereto through which refuse from the compacting unit is discharged into a container as will be described later with reference to FIGS. 7 and 8, and an access door 17 at the rear fitting between right-angled continuations 18 of the side panels 14. The access door 17 is to permit access to the internal mechanism of the unit for maintainance purposes.

The main body 10 houses an upwardly inclined trough 19 containing a helical compacting screw shown schematically at 20, the latter being driven via reduction gearing in a gearbox 21 from an electric (or hydraulic) motor 22. Refuse is loaded into the trough 19 via a hopper 23 at the top of the trough, and the rotating screw 20 compacts the refuse by pushing it through an opening 24 in the end of the trough. The edge 25 of the opening 24 acts as a shearing blade, and refuse is trapped between the screw 20 and the edge 25 and partially pulverised at the same time as being squeezed through the opening 24.

The motor 22 is located generally below the trough, and the motor 22, the compacting trough 19 and the loading hopper 23 occupy the minimum amount of floor space, typically about 1½ square meters or less. Because of the partial pulverising as well as compacting effect and the relatively small size of the opening 24 into the container, typically about 60 cms diameter the compacted refuse will flow inside the container to fill the container. A projecting drip bar 52 prevents liquid material from running back from the outlet of the extension piece 16. Liquid will therefore drop from the drip bar 52 into the container 47. Conventional refuse compactors using reciprocating ram plates depend on the resistance of the container to achieve their compaction and the refuse must be packed in at one end of the container using a compactor with a relatively large opening into the container. Thus the compactor ram and the container must be in line with each other making a long narrow installation. The screw system enables the refuse to be packed into the container at any point and at any angle as the material will flow within the container to fill all the space, the main compaction having been already carried out within the screw and trough assembly. The screw and trough are, as previously mentioned, inclined upwards towards the container so that the loading height is low whilst the refuse enters the container at a point above the floor level. This allows the container to be made water tight at floor level and prevent leakage at this point.

Fixed to each of the side walls 38 of the hood 11 are the respective ends of a pair of crosspieces 53 of angle steel, located so as to overhang the front or output region of the hopper 23. These crosspieces 53 serve to wedge bulky objects of refuse, such as large empty cardboard boxes, between themselves and the compaction screw 20. Without this provision such objects have a tendency to remain above the rotating compaction screw, since they have major dimensions greater than the pitch of the screw. When the crosspieces 53 or equivalent obstructions are provided this problem is overcome.

Along the lower edge of each side panel 14 there is fixed a respective inverted channel 27 which interlocks with a respective upwardly directed roller 28 (FIG. 7) attached to the bottom of a respective sliding door 29. The reason for this will be described later, as will the purpose of mounting lugs 31 which are fixed at opposite sides of the front 15.

The front end of the trough 19 is supported on the front wheel 12 via a bracket 26. The rear end of the trough is supported by the gearbox 21 which in turn is supported via brackets 33 on the rear wheels 13. The motor 22 is bolted directly to the gearbox 21 by flanges 53. The unit further comprises a stop/start/reverse switch 34 and electrical switchgear 35 (FIG. 2) controlling the operation of the unit, and also a drain 36 from the trough 19 for washing down.

The detachable hood 11, comprising a front panel 37, side panels 38, and a top panel 39, has an open rear aspect to permit the loading of refuse into the hopper 23 from the rear, but is provided with a roller shutter 40 which may be drawn down (into the position 41 shown in dashed lines in FIG. 2) when the unit is not in use to prevent access by rodents or people to the premises in which the unit is installed.

With conventional compactor systems the compactor unit is rigidly mounted to the floor of the building, an empty container is dropped off by a truck roughly in alignment with the compactor unit and the container is then pulled into alignment with the compactor unit and fixed thereto by using screw clamps. Normally the container will weigh less than the compactor unit. With the screw type compactor unit described above, as the compactor unit is small and relatively light it is easier to align the compactor unit with the container than visa versa it is for this reason that the compactor unit is mounted on wheels 12, 13 so that it can be pushed into place against the container which need then be only roughly aligned with the compactor unit when the container is dropped off by the truck. Such a system is shown in FIGS. 7 and 8 of the drawings, where the compactor unit projects through the wall of a building, and is interlocked with sliding doors to enable the compactor unit to be wheeled in and out from the wall of the building as well as sideways or through an angle so that it will line up with a container which has not been accurately positioned. The interlocking arrangement with the sliding door prevents access to building when the container is removed. The truck driver can also remove the container for emptying without access to the inside of the building.

Figure 8:
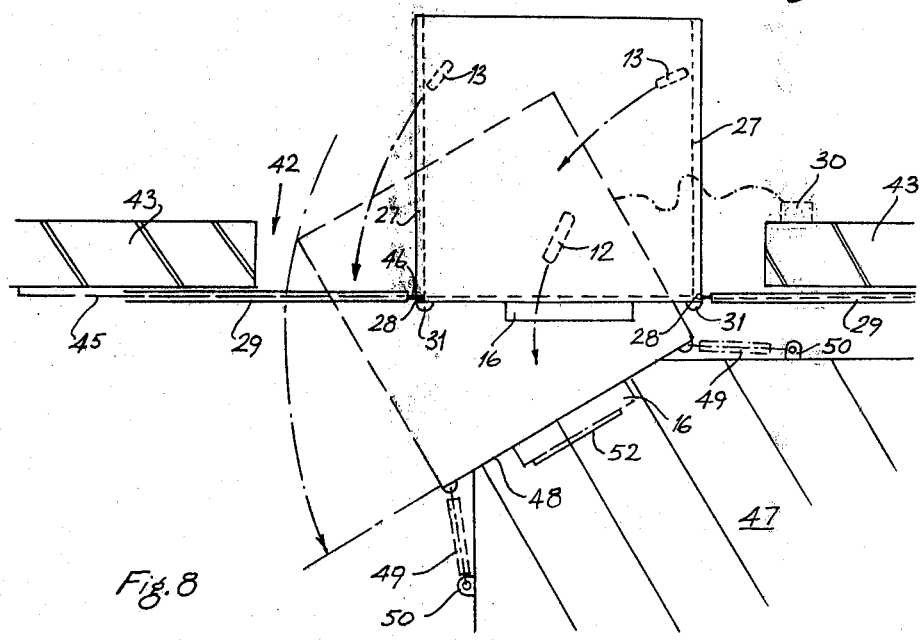

Referring now to FIGS. 7 and 8, the compactor unit is shown, in front elevation in FIG. 7 and in plan view (solid lines) in FIG. 8, in its fully retracted position wherein it is substantially wholly withdrawn inside the building in which it is installed. It will be seen that the unit is located in an aperture 42 in a wall 43 of the building between the pair of sliding doors 29 previously mentioned, the doors 29 being mounted in upper and lower door tracks 44, 45 respectively for movement parallel to the wall 43. The aperture 42 has a minimum width of about 7'0" and each door 29 is about 4'0" wide. As mentioned before, the lower end of each door 29 has an upwardly directed roller 28 mounted on a bracket 46, which roller enters and cooperates with a respective inverted channel 27 along the lower edge of each side panel 14.

It will be seen that this arrangement, when the wheels 12, 13 are pointed in the appropriate direction, permits horizontal movement of the compactor unit both in a direction perpendicular to the wall 43, i.e. outwardly of the building, and in a sideways direction parallel to the wall 43, and also permits angular rotation of the unit about a vertical axis. Naturally, any combination of such movements is also permitted. Furthermore, due to the interlocking of the doors 29 with the opposite sides of the unit by virtue of the cooperating rollers 28 and channels 27, in any position of the unit the doors and the unit together occupy substantially the full width of the aperture 42, thereby preventing access by unauthorised persons. Furthermore, the unit with its hood occupies substantially the full height of the aperture 42, as can be seen in FIG. 7. Draugh excluders are placed around the unit in the small gaps between the unit and the surrounding doors and door tracks, and electricity is fed to the unit from a supply terminal 30 via a flexible cable.

In use (FIG. 8) a container 47 into which the compacted refuse is to be received is parked by the truck driver alongside the building with the refuse-receiving opening of the container, which is located at a cut-away corner 48 there adjacent the compactor unit in the aperture 42. Now the compactor unit is pushed outwardly of the building in the required direction (indicated by the arrows) for mating of the extension piece 16 with the container opening, the lower door track 45 being cut away at 51 (FIG. 7) to allow the front wheel 12 to emerge from the building. The required direction is achieved by setting the wheels 12, 13 in the appropriate directions. It is not necessary for this to be done accurately, since provided that the front of the unit is brought sufficiently near the corner 48 of the container, the final accurate coupling is achieved by drawing the unit towards the container by the use of rigid adjustable links 49 (such as screw jacks) attached by the truck driver to lugs 50 on the container and the previously mentioned lugs 31 on the front of the unit.

Once the unit is securely coupled to the container 47 in its final position (shown in broken lines in FIG. 8), the refuse compacting operation can begin, with the compacted refuse being ejected into the container 47 via the extension 16. It will be seen that the system described above does not require the container 47 to be positioned accurately relative to the compactor unit, and furthermore it permits a choice in the positioning of the container 47 provided the corner 48 faces generally towards the aperture 42. The refuse input hopper 23 is accessible from inside the building, and the refuse output 16 is accessible from outside the building, for any position of the unit relative to the walls of the building. The container 47 can be removed without the truck driver's having access to the interior of the building, and the operatives of the compacting unit do not need to have access to the outside of the building.

In the foregoing embodiment of the invention the sliding doors 29 have been described as being of the rigid type which overlap the walls of the building when pushed open. However, it is to be understood that the sliding doors may be alternatively of the folding or "concertina" type.

In some applications it may be required to feed refuse into the compactor via a shute. In such a case the compactor unit assembley as illustrated in FIGS. 4 to 6 may be used without the detachable hood 11. In other applications it may be desired to feed the compactor mechanism from one side instead of from the front; in this case the detachable hood 11 can be turned through 90° relative to the compactor unit assembley.

I claim:

1. A refuse disposal system comprising a mobile refuse compacting unit located in an aperture in a wall of a building, the aperture being wider than the unit, a pair of sliding doors mounted for movement parallel to the wall and disposed one on either side of the unit, and means coupling the doors to opposite sides of the unit respectively so as to permit a degree of horizontal movement of the unit in directions both parallel and perpendicular to the wall respectively and also a degree of rotational movement of the unit about a vertical axis, the doors and the unit in any position of the latter occupying substantially the full width of the aperture, and the unit having a refuse input accessible from inside the building and a refuse output accessible from outside the building.

2. A refuse disposal system according to claim 1, wherein the compacting unit comprises a helical compacting screw adapted to receive refuse from the input and eject compacted refuse from the output.

3. A refuse disposal system according to claim 2, wherein the rotational axis of the screw is upwardly inclined towards the output.

4. A refuse disposal system according to claim 2, wherein the refuse input is at the top of the compacting unit and the refuse output is on the front of the unit external of the building.

5. A refuse disposal system according to claim 4, wherein the compacting unit further comprises a detachable hood disposed over the refuse input, the hood having a side opening for inserting refuse.

6. A refuse disposal system according to claim 5, further comprising a shutter to close off the side opening of the hood when the compacting unit is not in use.

7. A refuse disposal system according to claim 5, wherein the hood may be selectively positioned on the compactor unit to permit loading of the unit from the rear or from the side.

8. A refuse disposal system according to claim 5, wherein the hood and unit occupy substantially the full height of the aperture in the building.

9. A refuse disposal system according to claim 5, further comprising at least one crosspiece extending between opposite sides of the hood above the refuse input to the unit.

10. A refuse disposal system according to claim 2, wherein the sliding doors are coupled to opposite sides of the compacting unit by means of generally vertical rollers on the doors engaging respective channels extending along each side of the unit.

11. A refuse disposal system according to claim 10, wherein the channels are inverted and the rollers are directed upwardly.

12. A refuse disposal system according to claim 2, wherein the sliding doors are rigid doors which are slidable as a whole in tracks parallel to the wall.

13. A refuse disposal system according to claim 2, wherein the sliding doors are of the folding or concertina type.

* * * * *